US008783202B1

(12) United States Patent
Lowery et al.

(10) Patent No.: US 8,783,202 B1
(45) Date of Patent: Jul. 22, 2014

(54) SUBSURFACE OSCILLATING BLADE PROPELLOR

(75) Inventors: Scott Franklin Lowery, Panama City Beach, FL (US); Bryan Franklin Johnson, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 167 days.

(21) Appl. No.: 13/557,964

(22) Filed: Jul. 25, 2012

(51) Int. Cl.
*B63G 8/16* (2006.01)
*B63H 1/10* (2006.01)

(52) U.S. Cl.
USPC ..... 114/330; 440/93

(58) Field of Classification Search
CPC ..... B63H 5/16; B63H 1/02; B63H 1/04; B63H 1/06; B63H 1/08; B63H 1/10; B63H 1/36; B63H 16/12; B63H 1/30; B63H 1/32; B63H 16/04
USPC ..... 440/13, 17, 19, 93; 114/312, 313, 330, 114/337, 338
See application file for complete search history.

(56) References Cited

U.S. PATENT DOCUMENTS 4,648,345 A * 3/1987 Wham et al. ..... 114/338
8,585,451 B2 * 11/2013 Bleicken ..... 440/79

FOREIGN PATENT DOCUMENTS

GB 1125298 A * 8/1968
GB 1164896 A * 9/1969
GB 1427801 A * 3/1976

* cited by examiner

*Primary Examiner* — Lars A Olson
*Assistant Examiner* — Anthony Wiest
(74) *Attorney, Agent, or Firm* — James T. Shepherd

(57) ABSTRACT

A subsurface propeller module, using Voith Schneider propeller technology, is provided for use in underwater vehicle dynamic motion control. One or more modules are mounted between nose and body sections of the vehicle such that their axes of rotation coincide with the longitudinal centerline of the vehicle. This enables the module to thrust in any direction normal to the direction of travel. Wiring for power and sensors can be routed through structural conduits connecting the nose section to the main body of the vehicle and supporting the propeller modules. The structural conduits can be shaped to provide support for the nose and body sections, and to have minimal hydrodynamic impact on vehicle forward motion or module thrust. A sealed housing is provided for the motors and control actuators of the propeller modules.

13 Claims, 3 Drawing Sheets

SUBSURFACE OSCILLATING BLADE PROPELLOR

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates to underwater propulsion and maneuverability. More particularly, the present invention relates to a subsurface oscillating blade propeller adapted for use on an underwater vehicle.

(2) Description of the Prior Art

There is increasing reliance on underwater vehicles, both manned and unmanned, to perform missions such as underwater reconnaissance and mine detection, hydrographic mapping, and homeland defense missions such as swimmer and vehicle detection and ship hull or structure inspections. A variety of vehicles are employed for these missions. Though some have novel propulsion methods, the vehicles can normally be categorized into two main types, box-type and torpedo-type.

As their name implies, box-type vehicles are normally box shaped and use thrusters fixed in various positions for dynamic control. They may vary in size and are generally used for missions that do not require vehicle speed, but instead require the vehicle to slowly hover in the mission area. Box-type underwater vehicles perform such missions as hull or target inspections and hardware recovery.

Torpedo-type underwater vehicles also vary in size. These vehicles generally use rearward facing propellers to move quickly through the water and are hydrodynamically shaped to lessen drag. These vehicles are typically used to cover large areas at speed. Torpedo-type underwater vehicles perform such missions as area reconnaissance and hydrographic mapping using side scan sonar and other sensors.

There are currently efforts to merge the two types of underwater vehicles by integrating fore and aft hover modules on torpedo-type underwater vehicles. Similar to the propulsion method of the box-type vehicles, hover modules consist of fixed thrusters. Each module normally contains a fixed vertical thruster and a fixed horizontal thruster.

The hover module system enables the vehicle to perform limited maneuvers including ascent and descent on a designated vertical plane, translation left and right on a designated horizontal plane, and rotation on a designated horizontal plane. A limitation of the system is that each of these behaviors uses only about 50% of the available thrust. Only one thruster in each module provides the maneuvering thrust with the other providing some small control thrust. To change direction when hovering, the thrusters must come to a stop and reverse direction.

Thus, a need has been recognized in the state of the art to provide systems for maneuvering a torpedo-type underwater vehicle. The systems need to minimally impact the hydrodynamics of the vehicle at high speed, while providing efficient maneuverability at slower speeds. Specifically, the systems need to provide thrust in any direction utilizing the maximum available power. Additionally, dynamic roll control, or stability of the vehicle at both slow maneuvering speeds and high speeds should not be adversely impacted, but should be enhanced.

SUMMARY OF THE INVENTION

It is therefore a general purpose and primary object of the present invention to provide a subsurface propeller module, using Voith Schneider propeller technology. The subsurface oscillating blade propeller provides for underwater vehicle dynamic motion control. One or more propeller modules are mounted such that their axes of rotation coincide with the longitudinal axis, or centerline, of the vehicle. This enables the module to thrust in any direction normal to the direction of travel. Additionally, this configuration has a minimal hydrodynamic impact on the vehicle during its normal forward motion.

The propeller modules can be located between the nose and main body sections of the vehicle. Wiring for power and sensors can be routed through structural conduits connecting the nose section to the main body section. The structural conduits can be shaped to provide support for the nose and body sections, as well as the propeller modules, and to have minimal hydrodynamic impact on vehicle forward motion or module thrust.

A sealed pressure housing is provided for the motor and actuators that control the pitch angle of the adjustable blades of the propellers. When two counter-rotating modules are used, the stability of the vehicle is enhanced through dynamic roll control.

In one embodiment, a system for maneuvering an underwater vehicle includes one or more oscillating blade propeller modules located between first and second sections of the underwater vehicle. The axes of rotation of the propeller modules coincide with a longitudinal axis of the underwater vehicle, such that the thrust of the propeller modules is in any direction perpendicular to the longitudinal axis. A motor module is connected to the propeller modules and struts connected between the first and second sections support the motor module.

The propeller modules can include contra-rotating oscillating blade propellers, which can include Voith Schneider-type propellers. The motor module can include a sealed housing. The sealed housing can enclose actuators connected to adjustable pitch blades of the propeller modules.

The support struts can form one or more passageways for wiring connected between a power source of the vehicle and the motor module. A cross-section of the motor module can conform to a cross-section of the vehicle. Also, the radial dimension of the motor module can be equal to or less than the radial dimension of the vehicle.

The motor module can be located between a nose section and a body section of said vehicle. The support strut passageways can include passageways for wiring connected between the nose section and the body section.

In one embodiment, a system for maneuvering an underwater vehicle can include one or more Voith Schneider-type propeller modules located between a nose section and a body section of the underwater vehicle. The propeller modules have an axis of rotation coincident with the longitudinal axis of the underwater vehicle. A motor is connected to the propeller modules and actuators are connected between the motor and adjustable pitch blades of the propeller modules. A sealed housing encloses the motor and the actuators.

Struts for supporting the housing are connected between the nose section and the housing and connected between the body section and the housing. Sealed passageways are provided within one or more of the support struts for passage of wiring connected between a vehicle power source and the motor, and for wiring connected between the nose section and the body section. The propeller modules can include contra-rotating propellers. Also, a cross-section of the housing can conform to a cross-section of the vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like references numerals and symbols designate identical or corresponding parts throughout the several views and wherein.

DESCRIPTION OF THE INVENTION

Figure 1:
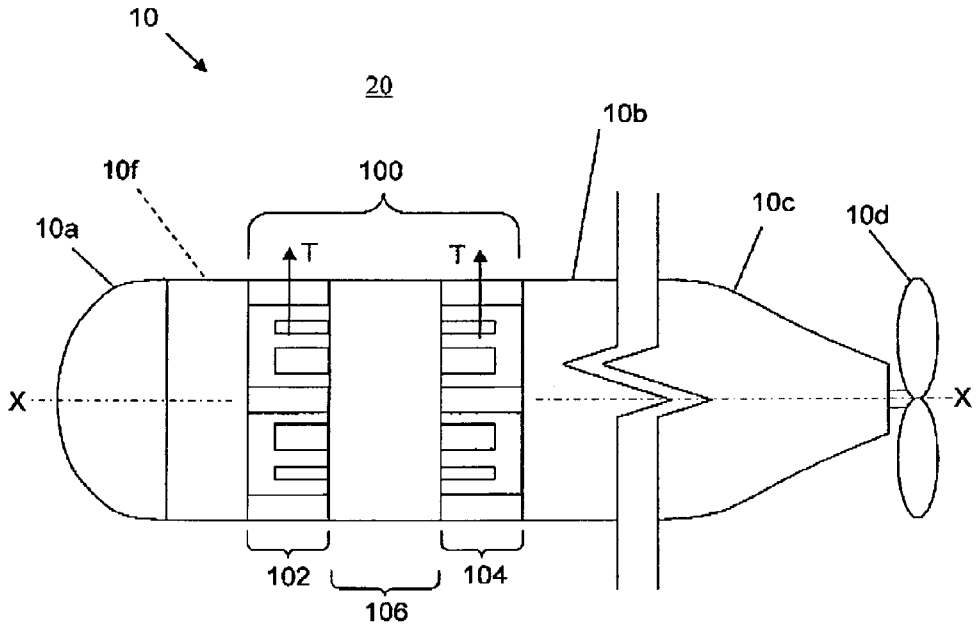
FIG. 1 illustrates a schematic side view of an underwater vehicle with a subsurface oscillating blade propeller system.

Referring now to FIG. 1, there is shown a schematic side view of underwater vehicle 10 with a subsurface oscillating blade propeller system 100 mounted thereon. Underwater vehicle 10 is of the torpedo-type. As is known in the art, torpedo-type vehicle 10 has a hydrodynamic shaped nose section 10*a*, an elongated body section 10*b* and a tapered tail section 10*c*.

Nose section 10*a* generally houses electronic sensor systems, such as those used for navigation, tracking, and mapping. Body section 10*b* generally houses power systems for both electronics and propulsion. Tail section 10*c* generally houses the propulsion unit, illustrated by propulsive propeller 10*d*.

System 100 includes a Voith Schneider-type propeller module 102. As is known in the art, Voith Schneider-type propellers are variously referred to as cycloidal propellers or vertical axis propellers, and are also referred to herein as oscillating blade propellers. In a typical application, these propellers—or propeller modules—are comprised of several narrow, vertical, controllable pitch blades that extend below a vessel's hull from a rotating plate that is turned by the vessel's motor. The blades are substantially parallel to and centered around the axis of rotation of the rotating plate. Each individual blade's pitch (or angle) can be adjusted as required to create thrust in any direction normal to the axis of the rotating plate. As will be explained in further detail hereinafter, system 100 can also include a second contra-rotating Voith Schneider-type propeller module 104. The term "contra-rotating," as used herein, means that module 104 rotates in the opposite direction from module 102 in order to counteract torque-induced rolling forces on the vessel applied by the respective propeller modules. As is discussed and illustrated wherein, propeller modules 102 and 104 are positioned so that their blades 108 and axes of rotation are parallel to the vehicle's centerline X-X, rather than extending vertically downward from the vessel as in the typical installation of these types of propulsors. Propeller modules 102 and 104 are mounted between nose section 10*a* and body section 10*b* of vehicle 10. Motor module 106 is located between propeller modules 102 and 104 and provides for axial rotation of propeller modules 102 and 104.

As is known in the art, a Voith Schneider propeller provides thrust in any direction perpendicular to its axis of rotation. Propeller modules 102 and 104 are mounted on vehicle 10 such that the axes of rotation of propeller modules 102 and 104 both coincide with longitudinal axis, or centerline, X-X of vehicle 10. Accordingly, the thrust provided by propeller modules 102 and 104 is perpendicular to centerline X-X, as illustrated by arrows T in FIG. 1. Although thrust T is shown in the vertical direction in FIG. 1, it should be understood that thrust T can be provided in any direction that is perpendicular to centerline X-X, the direction depending on the pitch of the blades in the propeller modules 102 and 104, as is discussed in more detail below.

Figure 2:
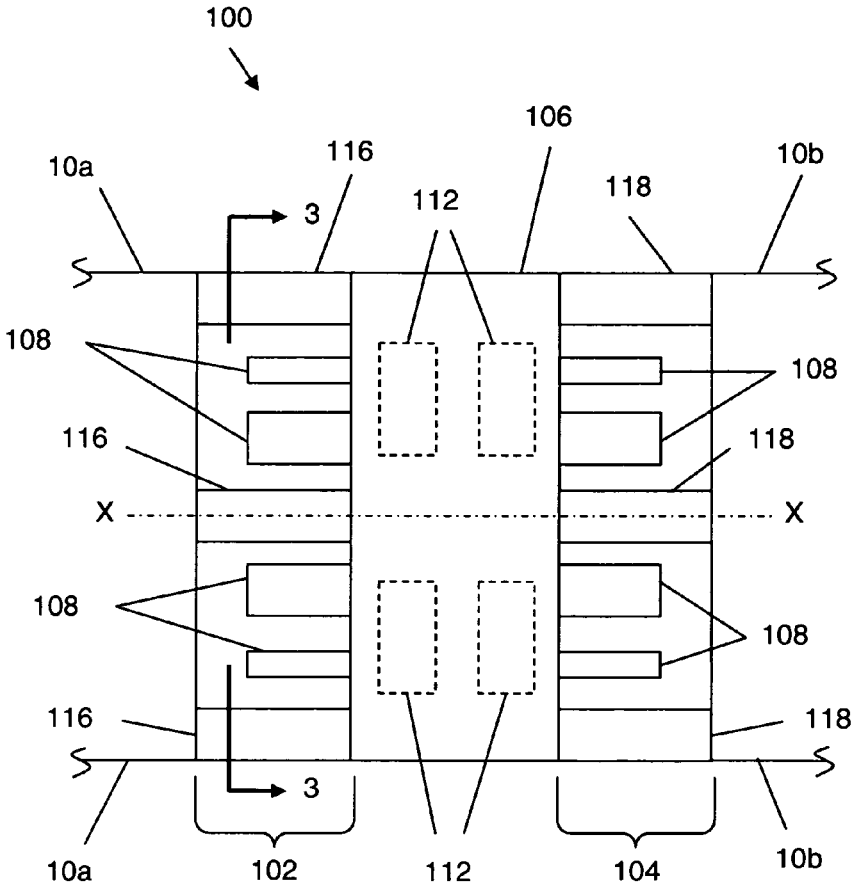
FIG. 2 illustrates a detailed view of the subsurface oscillating blade propeller system of FIG. 1.
Figure 3:
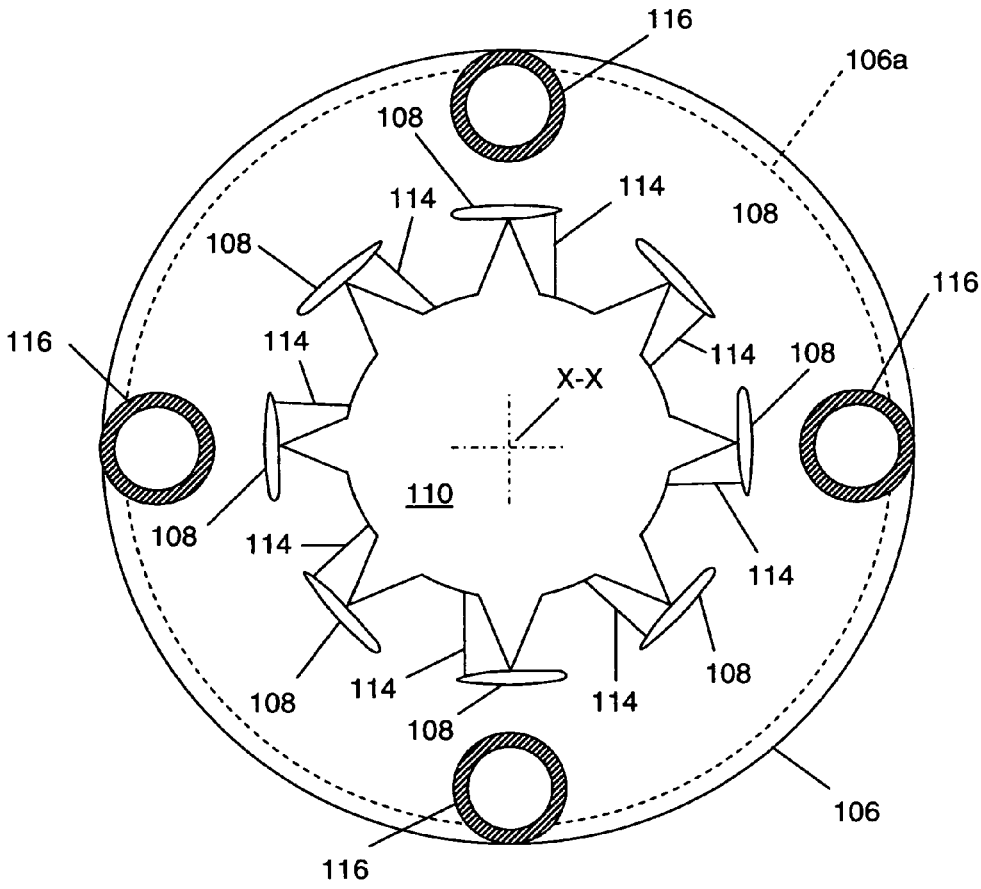
FIG. 3 illustrates a sectional view of the subsurface oscillating blade propeller system of FIGS. 1 and 2, taken at line 3-3 of FIG. 2.

Referring also to FIG. 2, there is shown a more detailed schematic view of system 100. As previously described, motor module 106 is positioned between propeller modules 102 and 104. Referring also to FIG. 3, there is shown a schematic cross-sectional view of propeller module 102 taken at line 3-3 of FIG. 2. It is noted that the following description with reference to FIG. 3 also applies to propeller module 104.

The thrust, T, described with respect to FIG. 1, is provided by blades 108 mounted on rotor 110 (shown in FIG. 3, but not shown in FIG. 2 for clarity) and extending longitudinally, substantially parallel to centerline X-X. As shown in FIG. 1, and as is known in the art, blades 108 are exposed to the ambient seawater environment so that they can generate thrust when they rotate about centerline X-X, interacting with the seawater 20. Rotor 110 is connected to motor module 106, such that operation of motor module 106 rotates rotor 110 and blades 108 about centerline X-X, which is perpendicular to the plane of FIG. 3. As is known in the art, the pitch of a propeller blade can be changed by adjusting the blade angle. As shown in FIGS. 2 and 3, one or more actuators 112 (shown in phantom in FIG. 2) can control linkage rods 114 connected to rotor 110 and blades 108 so as to change the blade angle and, thus, the pitch of blades 108 as blades 108 rotate, providing thrust in the desired direction about centerline X-X.

Motor module 106 is supported between propeller modules 102 and 104 by forward struts 116 and aft struts 118. As illustrated in FIG. 2, forward struts 116 are fixed to nose section 10*a* and extend rearward to connect to motor module 106. Aft struts 118 are fixed to body section 10*b* and extend forward to connect to motor module 106. To prevent interference, rotor 110 and blades 108 are sized such that the maximum distance of blades 108 from centerline X-X is less than the distance from centerline X-X to struts 116 (and struts 118), as illustrated in FIG. 3.

As noted previously with respect to FIG. 1, body section 10*b* generally houses electronic power systems. Thus, one or more of struts 116 and one or more of struts 118 can be in the form of a conduit for passage of wiring between body section 10*b* and nose section 10*a* and also to motor module 106. For underwater use, motor module 106, actuators 112 and wiring conduit struts 116 and 118 can be sealed from the ambient environment using techniques commonly known in the art.

What have thus been described are systems and methods for dynamic motion control of underwater vehicle 10. One or more subsurface propeller modules (102, 104), using Voith Schneider propeller technology, are mounted such that their axes of rotation coincide with the centerline (X-X) of vehicle 10. This enables modules 102 and 104 to thrust in any direction normal to centerline X-X.

By sizing motor module 106 and propeller modules 102 and 104 to conform to the dimensions of vehicle 10, the configuration has minimal hydrodynamic impact on vehicle 10 during its normal forward motion. Wiring for power and sensors can be routed through structural conduits that support motor module 106 and connect nose section 10*a* to body section 10*b* of vehicle 10. Motor module 106 and actuators 112 for changing the pitch of propeller blades 108 can be contained within sealed pressure housing 106*a* (illustrated in phantom in FIG. 3), allowing for the penetration of linkage rods 114 and wiring.

Obviously many modifications and variations of the present invention may become apparent in light of the above teachings. For example, FIGS. 1 and 2 illustrate two propeller modules (102, 104). Dynamic control can also be obtained using only a single propeller module. However, the use of propeller modules 102 and 104 can provide redundancy in case of damage to one propeller module. Additionally, by having propeller modules 102 and 104 rotate in opposite directions, propeller modules 102 and 104 can provide a measure of roll control in the manner of the contra-rotating rotors of a helicopter.

In FIGS. 1, 2 and 3, motor module 106 is illustrated as having the same radial dimension as nose section 10*a* and body section 10*b*. However, motor module 106 may have a smaller radial dimension such that struts 116 and 118 can be combined into one continuous strut between nose section 10*a* and body section 10*b*. Though not preferred due to the adverse impact on vehicle 10 hydrodynamics, motor module 106 may have a radial dimension greater than nose and body sections 10*a* and 10*b*.

Additionally, subsurface oscillating blade propeller system 100 need not be located between nose and body sections 10*a* and 10*b*. Depending on the design of vehicle 10, a forward body section 10*f* (designated in phantom in FIG. 1) can be located between system 100 and nose section 10*a*. Further, subsurface oscillating blade propeller system 100, as described herein, can be, adapted for use on box-type underwater vehicles to provide both improved propulsion and maneuverability.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A system for maneuvering an underwater vehicle comprising:

at least one oscillating blade propeller module located between a nose section and a body section of said underwater vehicle, each said at least one propeller module having rotor with an axis of rotation coincident with a longitudinal centerline of said underwater vehicle and a plurality of adjustable pitch blades mounted on said rotor and extending axially therefrom about an axis substantially parallel to said longitudinal centerline, wherein said at least one propeller module is operable to provide a thrust perpendicular to said axis of rotation;

a motor module operatively connected to said at least one propeller module; and support struts connected between said nose section and said motor module and connected between said body section and said motor module.

2. The system of claim 1, wherein said at least one propeller module comprises two propeller modules configured to rotate in opposite directions.

3. The system of claim 2, wherein said motor module further comprises a sealed housing.

4. The system of claim 3, further comprising actuators coupled between each of said blades and said motor module; wherein each of said at least one propeller module comprises a plurality of adjustable pitch blades, said actuators are operable to rotate said blades to change their pitch, and said sealed housing encloses said actuators.

5. The system of claim 4, wherein said support struts form at least one passageway for wiring connected between a power source of said vehicle and said motor module.

6. The system of claim 1, wherein said support struts form at least one passageway for wiring connected between a power source of said vehicle and said motor module.

7. The system of claim 6, wherein said at least one passageway comprises a passageway for wiring connected between said nose section and said body section.

8. The system of claim 1, wherein a cross-section of said motor module conforms to a cross-section of said vehicle.

9. The system of claim 8, wherein the radial dimension of said motor module is no greater than the radial dimension of said vehicle.

10. The system of claim 1, wherein said motor module comprises a sealed housing.

11. An underwater vehicle having multi-directional maneuverability, said vehicle comprising:

a nose section having a centerline and radial dimension;

a body section having a radial dimension and a centerline coincident with said nose section centerline;

at least one oscillating blade propeller module disposed between said nose section and said body section, said propeller module comprising a rotor and a plurality of adjustable pitch blades rotatably coupled to the periphery of said rotor and extending axially therefrom substantially parallel to said centerlines, wherein said blades are exposed to the ambient environment and said blades are located at a distance from said centerlines less than said radial dimensions of said nose section and said body section;

a motor module disposed between said nose section and said body section, said motor module comprising actuators, wherein said motor module has a radial dimension less than or equal to said radial dimensions of said nose section and said body section, and said motor module is sealed from the ambient environment;

linkage rods coupling said blades to said actuators, wherein said actuators and said linkage rods are operable to rotate said blades to change their pitch; and at least one longitudinal strut coupling said propeller module to one of said nose section and said body section, wherein said at least one longitudinal strut is located at a distance from said centerlines greater than the distance of said blades from said centerlines.

12. The underwater vehicle of claim 11, wherein said at least one propeller module comprises a pair of propeller modules configured to rotate in opposite directions.

13. The underwater vehicle of claim 11, further comprising a power source disposed within one of said nose section and said body section, and wherein said at least one strut forms at least one passageway for wiring connected between said power source and said motor module and for wiring connected between said nose section and said body section.

* * * * *